US005136932A

United States Patent [19]

Giamello

[11] Patent Number: 5,136,932

[45] Date of Patent: * Aug. 11, 1992

[54] RADIAL PISTON HYDRAULIC MOTOR OF VARIABLE CYLINDER CAPACITY

[76] Inventor: Bruno Giamello, Corso Piave 66, Alba (Cuneo), Italy

[*] Notice: The portion of the term of this patent subsequent to May 7, 2008 has been disclaimed.

[21] Appl. No.: 664,211

[22] Filed: Mar. 4, 1991

Related U.S. Application Data

[62] Division of Ser. No. 353,110, May 17, 1989, Pat. No. 5,012,724.

[30] Foreign Application Priority Data

May 19, 1988 [IT] Italy ..... 67464 A88
Feb. 17, 1989 [IT] Italy ..... 67097 A89

[51] Int. Cl.[5] ..... F01B 13/06
[52] U.S. Cl. ..... 91/497
[58] Field of Search ..... 91/497

[56] References Cited

U.S. PATENT DOCUMENTS

| | | | |
|---|---|---|---|
| 3,610,106 | 10/1971 | Cavalieri | 92/72 X |
| 3,747,477 | 7/1973 | Aldinger | 91/497 |
| 4,195,553 | 4/1980 | Klie | 91/497 |
| 4,320,692 | 3/1982 | Komiya | 91/497 |
| 5,012,724 | 5/1991 | Giamello | 91/497 |

*Primary Examiner*—Gerald A. Michalsky
*Attorney, Agent, or Firm*—Herbert Dubno

[57] ABSTRACT

In a radial piston hydraulic motor of the "star-shaped" type the variation of the cylinder capacity is achieved by the fact that the motor crankshaft is provided with a mechanism which varies the eccentricity, this mechanism being powered by hydraulic actuators carried by the shaft and controlled by a circuit external to the frame of the motor, comprising a rotating coupling and stop valves, while stability of the cylinder capacity may be obtained by means of locking mechanisms carried on the shaft.

6 Claims, 7 Drawing Sheets

RADIAL PISTON HYDRAULIC MOTOR OF VARIABLE CYLINDER CAPACITY

This is a divisional of co-pending application Ser. No. 07/353,110 filed on May 17, 1989, now U.S. Pat. No. 5,012,724.

FIELD OF THE INVENTION

The present invention relates to a radial piston hydraulic motor of the "star-shaped" type of variable cylinder capacity.

BACKGROUND OF THE INVENTION

In motors of this type, the pistons cause the rotation of the motor crankshaft which is supported in bearings located in housings set in the frame or integral with the frame, by acting on the eccentric part of the shaft. The cylinders in which the pistons slide may be integral with the frame or hinged to it. In some known versions of rotary motors of variable cylinder capacity, the variation of the cylinder capacity is obtained by varying the eccentricity of the crankshaft by means of hydraulic jacks controlled by valves which are located in the shaft and are supplied through a rotating collector formed by making use of the connection between a pin of the shaft and the frame, with the aid of seals for the rotating shaft. These variable-capacity rotary hydraulic motors have various disadvantages: for example, they do not have a cylinder capacity which is stable at all the values within the range of variation; they have to be dismantled and disconnected from the controlled parts for the maintenance of the aforesaid valves and seals for the rotating shaft (which are subject to much stress); and they are subject to considerable energy losses due to friction and leakage. All of the above factors combine to make such motors deficient in performance, reliability and efficiency, which considerably limits their application.

OBJECT OF THE INVENTION

The object of the present invention is to provide a radial piston hydraulic motor of variable cylinder capacity which is free from the disadvantages mentioned previously.

SUMMARY OF THE INVENTION

According to the invention, this object is achieved by providing a radial piston hydraulic motor of the star-shaped type with variable cylinder capacity, having mechanisms varying the eccentricity of the motor crankshaft, these mechanisms being powered by hydraulic actuators carried by the shaft, these actuators being connected to a control circuit external to the motor by means of a rotary coupling caused to rotate by the motor shaft, and by means of stop valves, the said coupling and the said valves being external to and separate from the shaft itself, while further means for varying and stabilizing the eccentricity of the motor crankshaft are provided and are powered by hydraulic actuators carried by the shaft itself, these means preferably consisting of a ring integral with the shaft with respect to rotation and capable of being radially displaced by means of one or more hydraulic jacks, the said ring normally being locked in its radial or axial position with respect to the said shaft by means of a mechanical coupling which may, for example, be frictional, and which can be disengaged in a controlled way.

BRIEF DESCRIPTION OF THE DRAWING

Other characteristics and advantages of the invention will be found in the following description which describes embodiments represented in the attached schematic drawing, in which.

SPECIFIC DESCRIPTION

Figure 1:
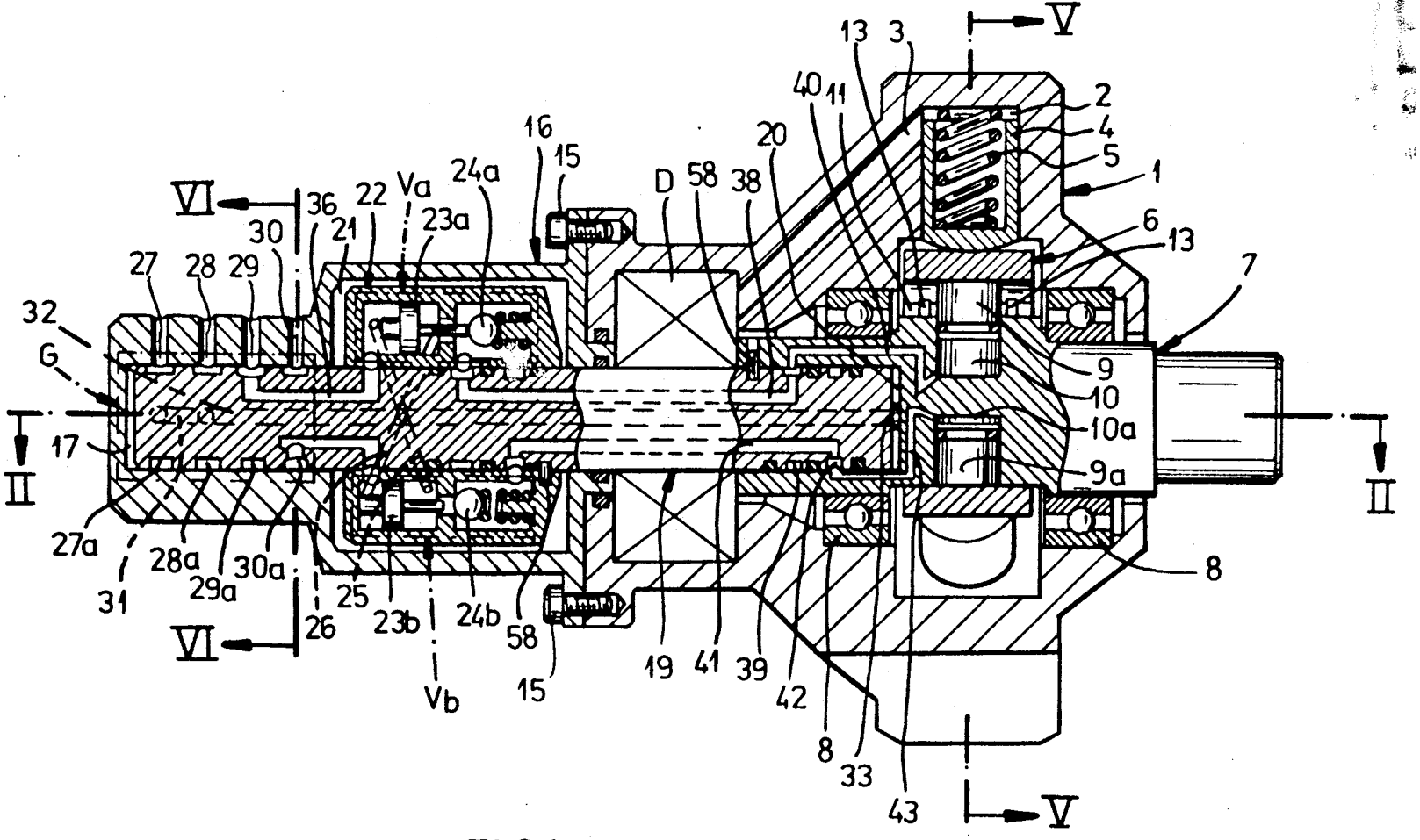
FIG. 1 is a longitudinal section illustrating a motor according to the invention.

The motor illustrated in the drawing comprises a frame 1 in which are formed a number of cylinders 2, each of which communicates through a hole 3 with a distributor D (shown schematically) of the "radial" or "axial" type, similar to that commonly used in piston-type hydraulic motors to permit cyclical supply to and discharge from the cylinders in phase with the rotation of the motor shaft. The pistons 4 slide in the cylinders 2, are opposed by the springs 5, and bear on the cylindrical external surface of a ring, 6, which is fixed with respect to rotation to the motor shaft 7. This shaft is supported by bearings 8 located in coaxial seats formed centrally in the frame 1. Within certain limits, the ring 6 can slide radially with respect to the axis of the shaft 7 under the action of the small opposed coaxial pistons 9 and **9*a*, which bear on the internal surface of the said ring and slide in a fluid-tight way inside the opposed cylinders 10 and 10*a* which are formed in the motor shaft 7 perpendicularly to its axis. In addition to this general arrangement, reference will now be made to FIGS. 1 to 12, from which it will be seen that the ring 6 is provided internally with two opposite and parallel flat surfaces 11, sliding on homologous surfaces 12 formed in the shaft 7; wedge-shaped teeth, 13 and 14, are formed in surfaces 11 and 12 respectively, with longitudinal axes which are rectilinear and perpendicular to the axis of the shaft 7 (see, for example, FIGS. 2 and 4**).

The teeth 13 are engaged, by bearing on the flanks, with corresponding cavities formed in the shaft 7, and similarly the teeth 14 are engaged with cavities formed in the ring 6. The teeth 13 and 14 guide the ring 6 radially and fix it axially. At the end of the frame 1, on the side of the distributor D, there is fixed centrally with screws 15 a cylindrical housing 16 having circular coaxial holes 17 and 18 in which rotates a pin 19 (which passes through the center of the distributor D) having one end in the hole 17 and the other end inserted in a circular hole 20 formed in the shaft 7, to which the pin 19 is secured with respect to rotation. In a hole 21 inside the housing 16 is placed a cylindrical body 22, keyed to the pin 19, which carries the controlled stop valves Va and Vb, functionally analogous to known types used in oil hydraulic systems. Referring to FIG. 1, the said valves essentially consist of small double-acting pistons (23*a*, 23*b*) which, when appropriately activated, can displace corresponding spheres (24*a*, 24*b*) which are normally held by springs against sealing seats. At the same time, the valves Va and Vb can be released alternately by means of two holes, 25 and 26, which interconnect the opposed chambers formed by the small pistons 23*a* and 23*b* and their respective cylinders. The radial holes 27, 28, 29 and 30 are also formed in the housing 16 and communicate with the annular grooves, 27*a*, 28*a*, 29*a*, and 30*a* respectively, formed in the pin 19. The assembly formed by the end of the pin 19 coupled to the hole 17 and by the holes 27, 28, 29 and 30 with their respective grooves substantially forms a rotating coupling G. The grooves 27*a* and 28*a* communicate with the holes 31 and 32 respectively, which are formed longitudinally in the pin 19 and in their turn communicate through the couplings 33 with holes 34 and 35 respectively, which are formed in the shaft 7. The hole 34, in turn, communicates with one of the two matched pairs of surfaces 11 and 12, while the hole 35 communicates with the other pair of surfaces 11 and 12 opposed to the preceding pair (see FIG. 2).

With particular reference to FIG. 1, the hole 36, which puts the groove 29*a* into communication with the valve Va, and the hole 37, which puts the groove 30*a* into communication with the valve Vb, are also formed inside the pin 19. The valve Va is connected in a perfectly fluid-tight way with the cylinder 10 through a hole 38 and a groove 39 (formed in the pin 19) and a hole 40 formed in the shaft 7. Similarly, the valve Vb is connected in a perfectly fluid-tight way with the cylinder 10*a* through a hole 41 and a groove 42 (formed in the pin 19) and a hole 43 formed in the shaft 7.

Figure 7:
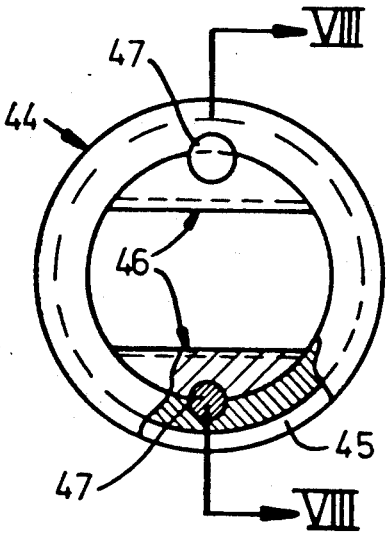
FIG. 7 is a front view illustrating a variant of certain details of the motor according to the invention.
Figure 8:
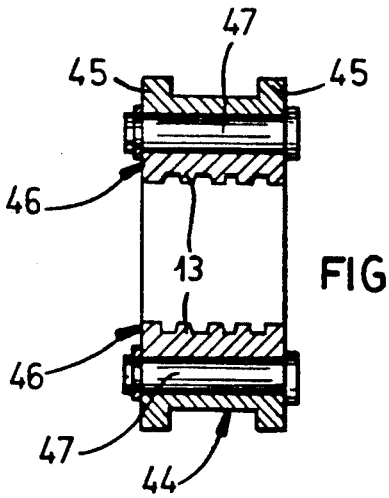
FIG. 8 is a section along the line VIII—VIII of FIG. 7.

FIGS. 7 and 8 show an element having the same functional purpose as the ring 6, but constructed from an assembly of various components, comprising a ring 44, provided with reinforcing collars 45, into whose hole are inserted two blocks 46, with a section in the form of a segment of a circle, fixed axially in the said ring by means of pins 47 inserted in axial holes common to the ring 44 and to the blocks 46. Wedge-shaped teeth, 13, identical to those previously considered in the ring 6, are formed in the blocks 46.

Figure 3:
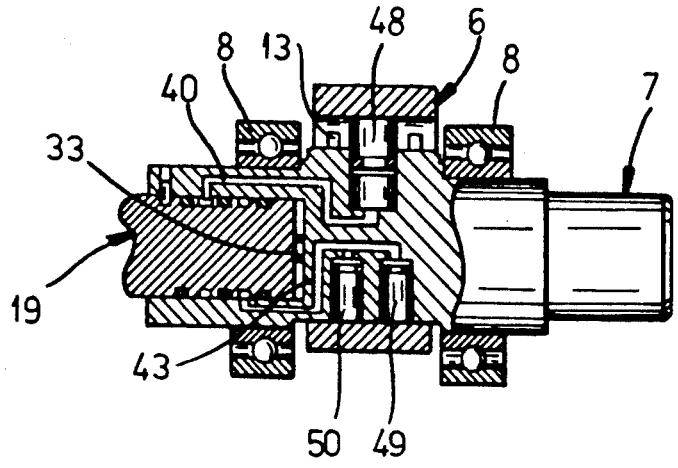
FIG. 3 is a partial longitudinal section which illustrates, on a reduced scale, a variant of certain details shown in FIG. 1.
Figure 4:
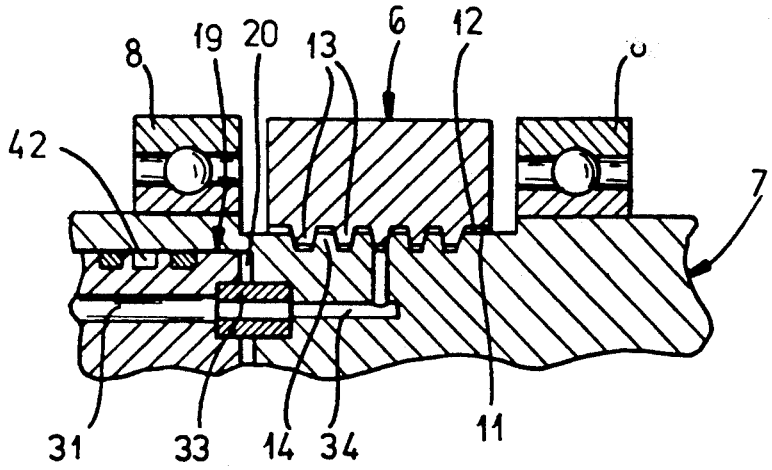
FIG. 4 is an enlarged representation of certain details of FIG. 2.
Figure 5:
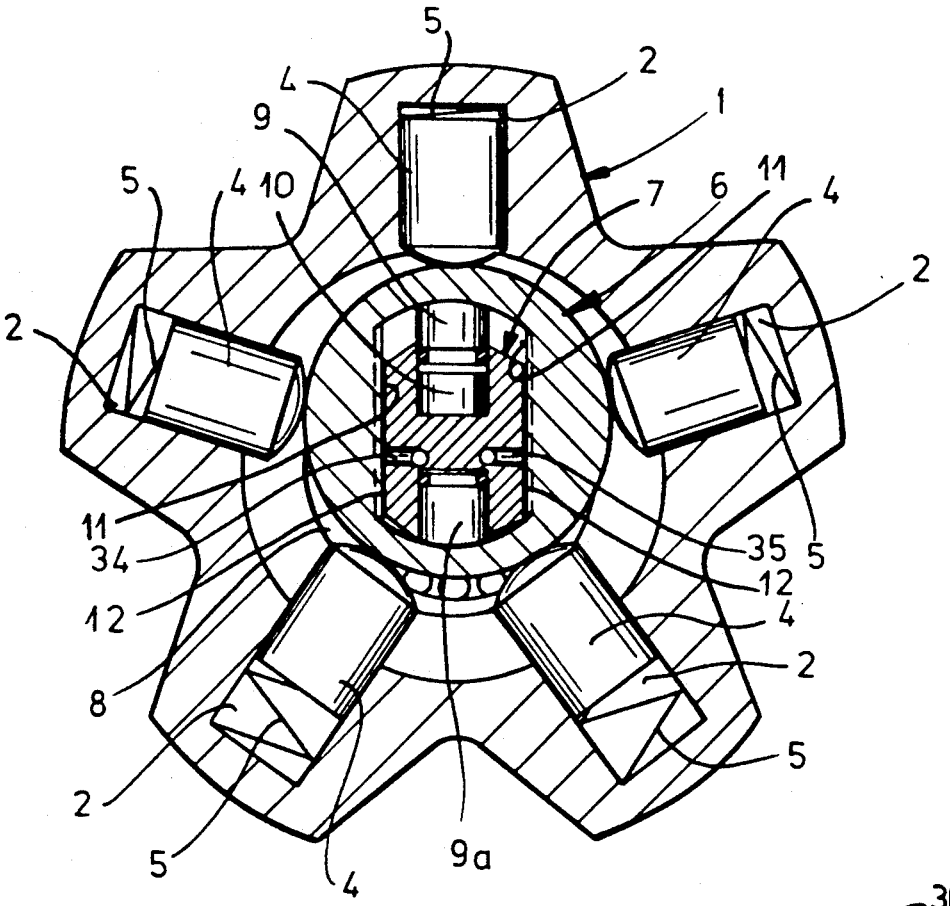
FIG. 5 is a section along the line V—V of FIG. 1.
Figure 6:
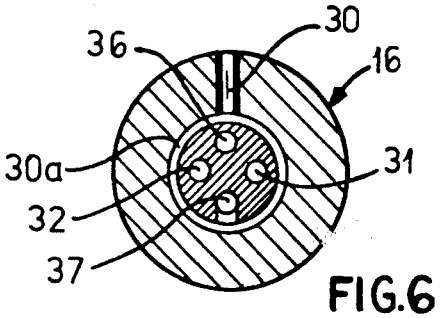
FIG. 6 is a section along the line VI—VI of FIG. 1.

With reference to FIG. 3, the solution illustrated is analogous to that shown in FIG. 1, with the difference that the displacement of the ring 6 is caused not by two but by three small pistons (with parallel and coplanar axes), 48, 49, and 50, which can slide in cylinders formed in the shaft 7; of these pistons, the piston 48 has the function of radially displacing the ring 6 to increase the eccentricity with respect to the shaft 7, while the other two (49 and 50) have the function of displacing the said ring in the opposite direction. The hole 43 is connected to both the cylinders in which the small pistons 49 and 50 slide.

Figure 10:
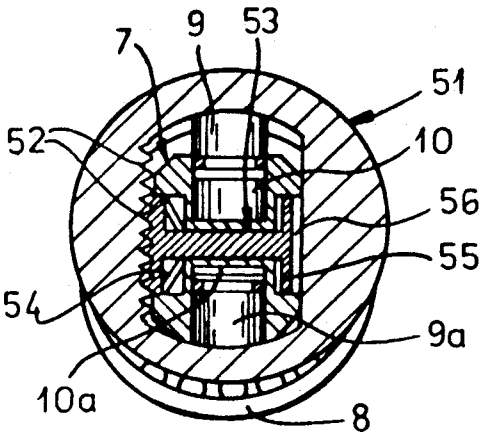
FIG. 10 is a section along the line X—X of FIG. 9.
Figure 9:
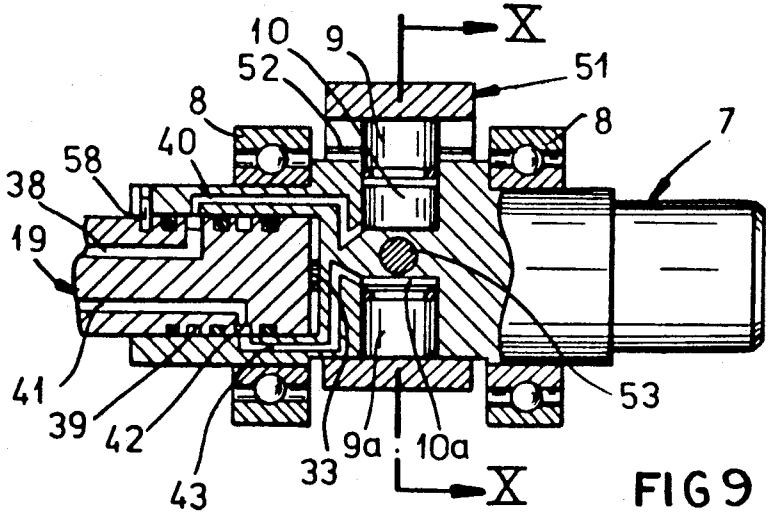
FIG. 9 is a partial longitudinal section representing the details of a variant of the motor according to the invention.

With particular reference to FIGS. 9 and 10, these substantially represent certain parts of the motor shown in FIG. 1, with the difference that the ring 6 is replaced by a ring 51 (which like the previous one is fixed with respect to rotation to the shaft 7 and can be moved radially with respect to the axis of this shaft by means of the small pistons 9 and 9*a*), having within it rectilinear stop teeth 52 (having their longitudinal axis perpendicular to the direction of radial displacement of the ring) which engage in the gaps between similar teeth formed in a pawl 53, fixed with respect to rotation to the shaft 7 but transversely movable in coaxial cylindrical seats formed in the shaft; the axis of the pawl is coplanar and perpendicular to that of the small pistons 9 and 9*a*. The teeth of the pawl normally mate with those of the ring 51 as a result of the thrust of a cup spring 54. The pawl 53 is integrally connected with a piston 55 which is movable in a cylinder 56 formed in the shaft 7; this cylinder may be supplied by means of the coupling G through holes (not illustrated) inside the shaft and the ring 19, in a similar way to that described previously (see FIG. 2).

Figure 2:
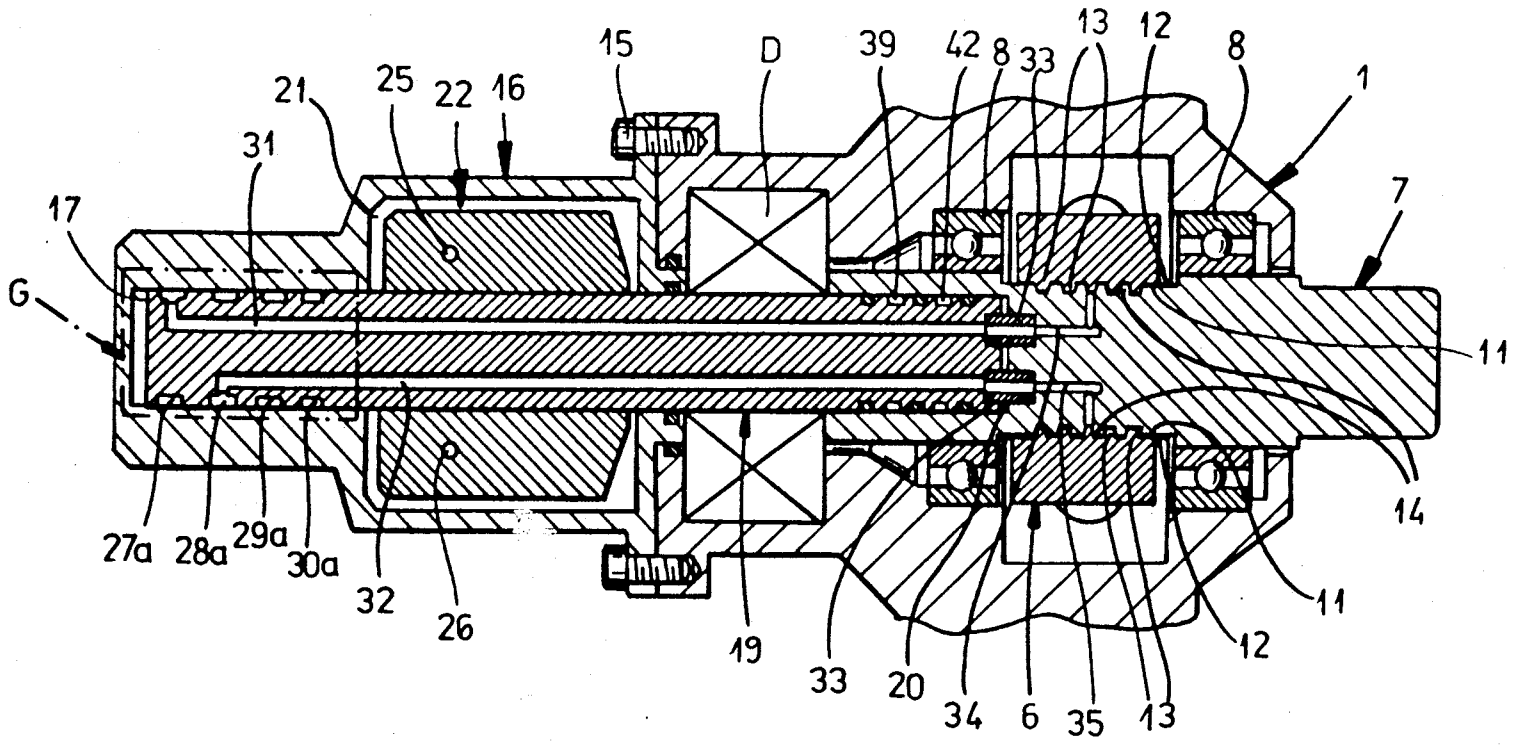
FIG. 2 is a longitudinal section along the line II—II of FIG. 1.
Figure 11:
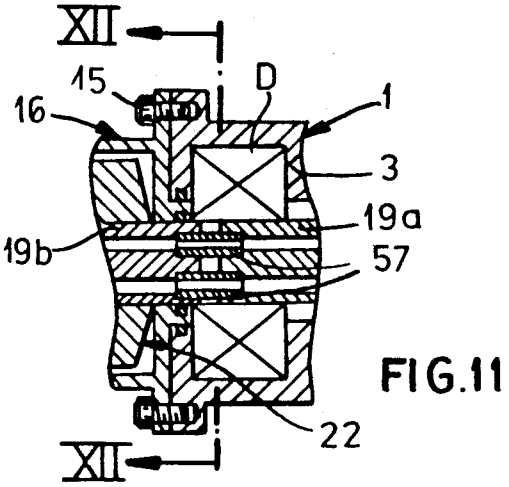
FIG. 11 is a partial longitudinal section illustrating, at a reduced scale, a variation of certain details shown in FIG. 1.
Figure 12:
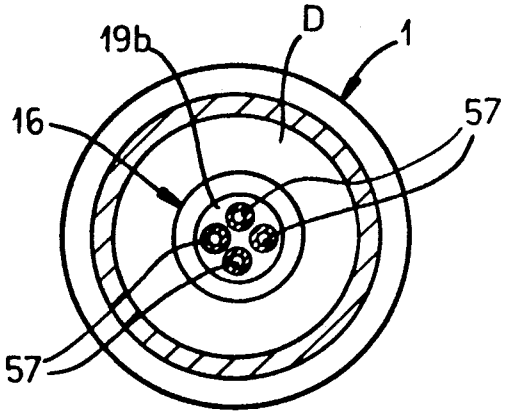
FIG. 12 is a section along the line XII—XII of FIG. 11.

With particular reference to FIGS. 11 and 12, these substantially represent certain parts of the motor according to the invention particularly visible in FIG. 2, with difference that, for the sake of simplicity of construction and assembly, the pin 19 consists of two separate parts, 19*a* and 19*b*, fixed with respect to rotation by the pierced couplings 57 which also form a fluid-tight connection between the longitudinal holes with which these parts are necessarily provided, being functionally analogous to the pin 19 formed in a single piece. The number 58 indicates cylindrical pins which are used to interconnect various components (FIGS. 1 and 9).

The operation of the motor described in the example of embodiment shown in FIGS. 1–12 is as follows:

As in all rotary motors, the shaft 7 is caused to rotate by the pistons 4 which are impelled by the pressurized oil supplied cyclically to the cylinders 2 through the distributor D (whose rotating parts are controlled by the shaft 7 or by the pin 19 through common connecting components which are not shown). In normal operating conditions with constant cylinder capacity, the stability of the cylinder capacity depends on the stability of the ring 6 (or 51) in its eccentric position with respect to the axis of the shaft 7.

During operation of the motor under load, the said ring is subject to cyclical alternating thrusts which tend to displace it radially and thus vary its eccentricity; it is also subject to forces which generate the rotation of the shaft 7 (and the corresponding torque) whose resultant lies in a plane perpendicular to the axis of the shaft 7, is normal to the direction of radial displacement of the ring, and passes through its central longitudinal axis (eccentric axis). In the motor according to the invention under load, the ring (6) remains mechanically locked in any radial position by the action of the said resultant, which presses the said ring against the shaft 7 (thus causing rotation) as a result of which the teeth 13 and 14 which are located on the side that is pressed against the shaft are wedged into their respective cavities, thus radially locking the ring by means of friction. By inverting the direction of rotation of the shaft 7, the teeth 13 and 14 opposed to the previously mentioned ones will be those which cause the ring 6 to be locked. The additional mechanism illustrated in FIGS. 9 and 10 is functionally a toothed coupling which can be controllably released and enables the ring 51 to be radially locked positively with respect to the shaft 7 in a certain number of graduated positions, by means of the locking function of the wedge-shaped teeth 52 which are normally engaged in the gaps between the similar teeth formed in the pawl 53, as a result of the thrust generated by the spring 54.

In the motor according to the invention, the radial locking of the ring 6 (or 51) is also achieved hydraulically as a result of the fact that the small pistons 9 and 9a (and also 48, 49, 50) slide in cylinders connected, in a perfectly fluid-tight way and without the interposition of moving seals (which are subject to a high rate of leakage and wear), with the locking valves Va and Vb (which rotate in the body 22 at the same angular velocity as that of the shaft 7), as a result of which, while the small piston 9 (or 48) impedes the radial displacement of the ring 6 (or 51) in one direction (by the opposing resistance of the oil held between the said piston and the respective locking valve), the small piston 9a (or 49 and 50), for the same reasons, impedes its displacement in the opposite direction. Hydraulic locking alone makes it possible to have only two mechanically stable and well-defined positions corresponding to the maximum and minimum cylinder capacity, where the ring 6 is in contact at the end of its travel with the shaft 7.

If the cylinder capacity of the motor is to be varied, it is first necessary to deactivate the mechanical locking systems of the ring 6 or 51: in the case of ring 6, this is done by supplying pressurized oil through the coupling G between the surfaces 11 and 12 (from the appropriate side, according to the direction of rotation of the motor); this provides a hydrostatic force which counteracts and overcomes that causing the frictional lock between the teeth 13 and 14, thus releasing the ring 6 from its mechanical fixing. Depending on the direction of rotation of the motor and the value of the torque supplied, it will be necessary to supply oil at adequate pressure either to one pair of surfaces 11 and 12 or to the opposite pair; if necessary, the hole 27 or 28 must be supplied, according to requirements. In order to radially disconnect the ring 51 from the shaft 7, it is necessary to supply, through the hydraulic rotating coupling G, pressurized oil to the cylinder 56; this will cause the displacement to the right (see FIG. 10) of the piston 55 which, overcoming the thrust of the spring 54, disengages the teeth of the pawl 53 from those of the ring 51. After the preliminary disconnecting operations specified above, the ring 6 (or 51) is radially displaced to obtain the variation of the cylinder capacity (see particularly FIGS. 1, 3, 9, and 10) by supplying pressurized oil through the coupling G and the valves Va or Vb to the cylinders in which the pistons 9 (or 48) or 9a (or 49 and 50) slide. For example, if the cylinder capacity is to be decreased, the hole 29 is supplied with pressurized oil; the said oil passes through the hole 36 to reach the valve Va which causes the cylinder 10 to be discharged through the holes 40, 38, 26, 37, and 30; simultaneously, the pressurized oil passes from valve Va to reach, through the hole 25, the valve Vb, and, passes through this and the holes 41 and 43 to reach the cylinder in which the small piston 9a (or 49 and 50) slides, causing its displacement and the consequent radial translation of the ring 6 (or 51) with respect to the axis of the shaft 7.

If the eccentricity of the ring 6 (or 51) is to be increased, the hole 30 must be supplied with pressurized oil; as a result of this, by a process similar and symmetrical to that described previously, the valve Vb will cause the discharge (to hole 29) of the cylinder in which the piston 9a (or 49 and 50) slides and, simultaneously, the valve Va will supply pressurized oil to the cylinder 10, with a corresponding displacement of the small piston 9 and similarly of the ring 6 (or 51).

Naturally, while the principle of the invention remains the same, its details may be varied widely with respect to what has been described and illustrated purely by way of example, and the form and arrangement of the various parts with respect to each other may be varied without thereby going outside the scope of the present invention; thus, for example, the small piston 9 may be functionally replaced by a spring; the radial locking of the ring 6 may be limited to hydraulic locking; the valves Va and Vb may be replaced by one double check valve with controlled release; and, within the limits of the invention, they may also be non-rotating and may form part of a circuit external to the motor which controls the small pistons 9 and 9a (and also 48, 49, 50), the respective cylinders being hydraulically connected to the said circuit by means of the coupling G and the suitably pierced pin 19; the grooves 27a, 28a, 29a, and 30a may be supplemented by moving seals to restrict leakage; the actuators which move the ring 6 (or 51) may be double-acting jacks arranged in any way in the shaft 7, and so on.

Figure 13:
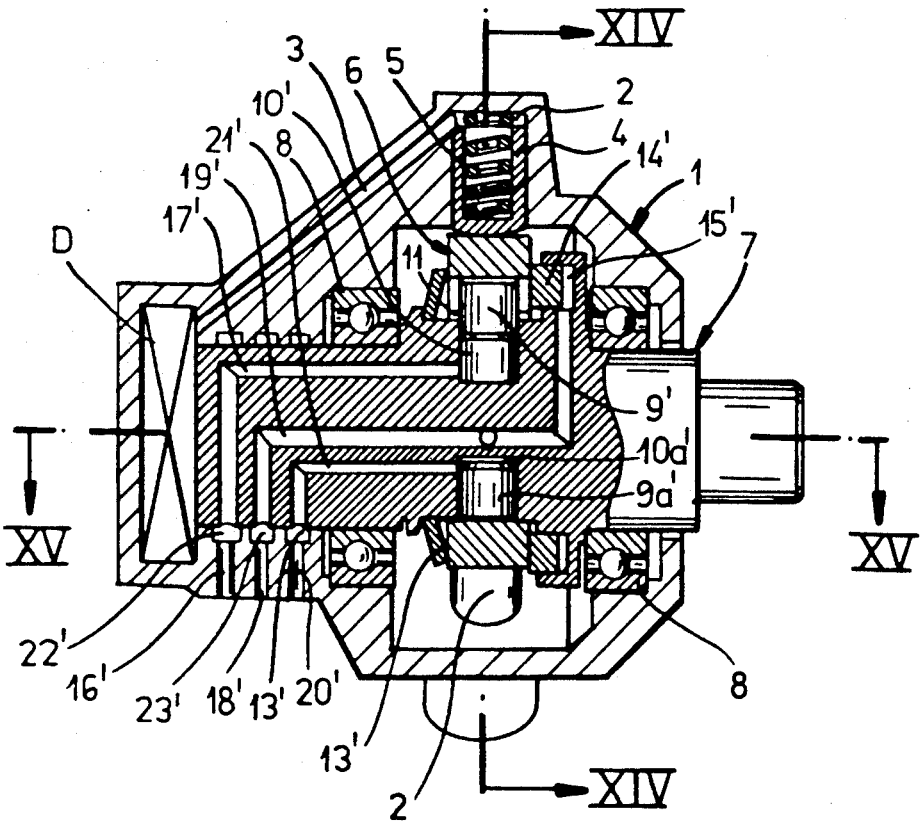
FIG. 13 is a longitudinal section illustrating an additional embodiment of the motor according to the invention.
Figure 14:
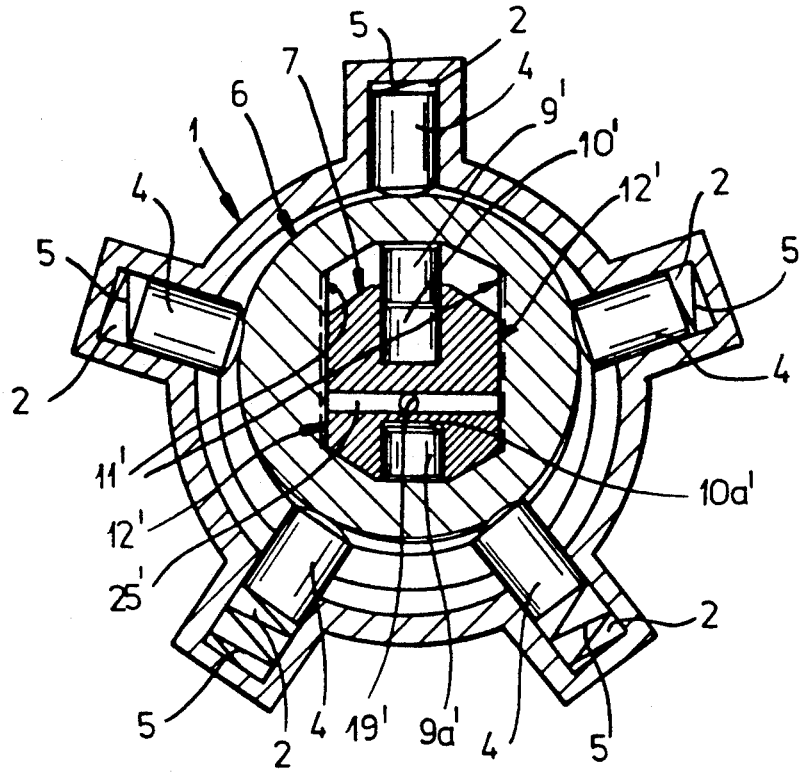
FIG. 14 is a section along the line XIV—XIV of FIG. 13.
Figure 15:
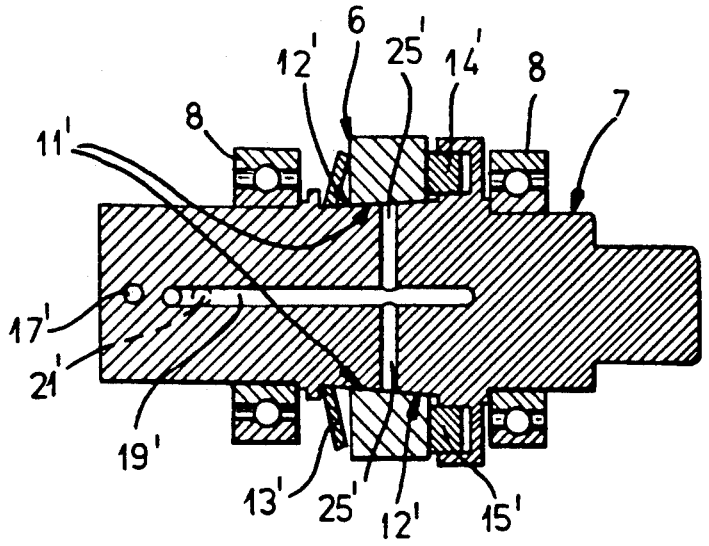
FIG. 15 is a partial section along the line XV—XV of FIG. 13.

With reference to the example of embodiment of the variant shown in FIGS. 13-14-15, a polygonal penetrating hole is formed centrally in the ring 6, and has two opposed and symmetrical surfaces (or sides) 11', in the form of inclined converging planes, which engage with similarly inclined surfaces 12' of the shaft 7, which substantially form the sides of a wedge formed in part of the said shaft (at a point approximately half way along its length), the longitudinal axis of this wedge being parallel and coplanar to the axis of the shaft. A cup spring 13' bears axially on the said ring 6, wedging it against the shaft 7 and consequently forming a frictional keyed connection. The ring 6 can be released from the shaft 7 by injecting pressurized oil between the surfaces 11' and 12' and/or by opposing the thrust of the spring 13' by means of the annular piston 14' (opposite to and coaxial with the spring 13') which can slide in the similarly annular cylinder 15' formed in the shaft 7. The cylinders 10', 10'a, and 15' can be supplied with pressurized oil from a circuit external to the frame 1 by means of the pairs of holes 16'-17', 18'-19', and 20-21' respectively; the holes 16', 18', and 20' are formed in the frame 1 and open to the outside of the frame, while the holes 17', 19' and 21' are formed in the rotating shaft 7; the holes 16'-17' are in constant communication through a groove 22' located between them; similarly, the holes 18'-19' communicate through a groove 23' and the holes 20'-21' communicate through a groove 24'. The said grooves, formed in the frame 1, can be supplemented with seals for the rotating shaft (not shown). The hole 19' communicates with an additional hole 25' (formed in the shaft 7), which in turn communicates with the surfaces 11' and 12'. Naturally, all the pistons (4, 9', 9'a, 14') can be fitted with piston rings as in normal constructional practice. The operation of the motor described above is as follows:

As in all radial piston motors, the eccentric shaft 7 is caused to rotate by the pistons 4 which are driven by pressurized oil which is supplied to the cylinders 2 cyclically through the distributor D, under the control of the eccentric shaft itself. In normal operating conditions with constant cylinder capacity, the stability of the cylinder capacity depends on the stability of the ring 6 in its eccentric position with respect to the axis of the shaft 7. During operation of the motor under load, the said ring is subject both to forces causing the useful rotation of the shaft 7 and also to alternating cyclical thrusts which tend to displace it radially and to vary its eccentricity. In the motor according to the variant, whether stationary or running under load or idling, the ring 6 is mechanically locked by friction in any given radial position by its keying to the shaft 7 as a result of the axial thrust of the spring 13'. In order to vary the cylinder capacity of the motor, pressurized oil is supplied to the hole 18'; this oil is consequently passed (through the groove 23' and the holes 19' and 25') between the surfaces 11' and 12', thus opposing the friction between these, and simultaneously reaches the cylinder 15' to cause the displacement of the piston 14' in the direction opposed to that of the thrust of the spring 13', as a result of which the friction lock between the ring 6 and the shaft 7 is released and the said ring becomes free to move radially as a result of the thrust of the small pistons 9 or **9*a* which increase or decrease the cylinder capacity respectively; for this purpose, pressurized oil is supplied to the holes 16' or 20' respectively and consequently to cylinders 10' or 10'*a*. Logically, the frictional coupling between the ring 6 and the shaft 7 will be restored when discharge is permitted through the hole 18'**.

The pressurized oil is passed from the cylinder capacity variation control circuit (external to the frame 1 and not represented because its characteristics are common) to the holes (17', 19', 21') in the rotating shaft 7 by means of a known system.

Many modifications may be made to what has been described and illustrated purely by way of an example, and the form and reciprocal arrangement of the different parts may also be varied, without thereby going outside the scope of the present invention; thus, for example, the thrust of the small pistons 9 or **9*a* may be sufficient to radially displace the ring 6 and vary the cylinder capacity, without the use of oil injection between the surfaces 11 and 12' and/or the thrust of the piston 14'; the actuators which displace the ring 6 may be one or more single- or double-acting hydraulic jacks arranged in any way on the shaft 7; the spring 13' may be replaced by any elements performing the same function of thrusting against the ring 6**; and so on.

I claim:

1. A hydraulic motor, comprising:

a housing;

a shaft journaled in said housing and rotatable about an axis of rotation;

means in said housing forming a plurality of radial cylinders angularly spaced around said shaft;

respective drive pistons reciprocatable in said cylinders and having inner ends turned toward said shaft;

a ring of circular outer periphery surrounding said shaft and interposed between said shaft and said inner ends, said inner ends bearing on said ring, said ring and said shaft having confronting guide surfaces respectively along an interior of said ring and an exterior of said shaft enabling said ring to shift radially on said shaft and thereby vary an eccentricity of said outer periphery of said ring with respect to said shaft;

piston means displaceable in said shaft and surrounded by said ring for displacing said ring radially relative to said shaft to set said eccentricity and thereby vary a capacity of said cylinders; and controllable locking means releasably securing said ring to said shaft at an eccentricity set by said piston means and disengageable for resetting of said eccentricity, said shaft being provided with an engaging element mounted rotatably fixed in said shaft, said controllable locking means including surfaces on said ring and said engaging element provided with respective pluralities of longitudinal teeth parallel to said axis of rotation of said shaft and automatically meshing with one another to prevent radial shifting of said ring by pressure of said drive pistons thereagainst, and hydraulic means for relieving pressing of said pluralities of teeth against one another to enable displacement of said ring by said piston means.

2. The motor defined in claim 1 wherein said engaging element is a pawl provided with:

a first flank formed with the respective plurality of teeth, a second flank parallel to said first flank and forming an inner chamber with said shaft and an outer chamber with said interior of the ring, said inner chamber communicating with said hydraulic means, and a bridging part connecting said flanks, so that said pawl has an "H" cross section, said shaft being formed with an undercut portion extending radially outwardly from said bridging part and forming a compartment with said first flank and with said bridging part of the pawl.

3. The motor defined in claim 2, further comprising a spring mounted in said compartment and generating a radial outward thrust against said first flank of the pawl ensuring thereby the locking position of said ring and said shaft, said pawl being displaced diametrically opposite to said radial thrust produced by said spring into said outer chamber upon receiving a hydraulic media by said inner chamber.

4. A hydraulic motor of a rotary type with variable cylinder capacity, comprising:

a motor frame;

a motor shaft journaled in said frame and rotatable about an axis of rotation and provided with an engaging element mounted rotatably fixed in said shaft and provided with a plurality of longitudinal teeth extending parallel to said axis of rotation;

an eccentric ring mounted on and rotationally coupled to said shaft;

hydraulic actuators carried by the shaft;

a rotating hydraulic coupling, caused to rotate by the shaft and connecting said actuators to a control circuit, said rotating coupling being integral with and external to the frame of the motor and connected hydraulically to the said actuators by means of elements which rotate with the shaft;

drive pistons radially shiftable in respective drive cylinders on said frame and bearing radially on said ring for driving said shaft; and a distributor for activating said drive pistons, said actuators comprising positioning pistons which slide in corresponding positioning cylinders in said ring, said ring being formed with a respective surface provided with a respective plurality of ring teeth meshing with said plurality of teeth of said engaging element forming locking means for preventing arbitrary radial shifting of said ring and for release upon actuation of said positioning pistons so that said ring is radially guided transversely to said axis of rotation, said ring being radially locked with respect to the axis of rotation by the locking means which can be relieved in a controlled way through said rotating hydraulic coupling.

5. A motor as defined in claim 4 wherein said engaging element is a locking pawl.

6. A motor as defined in claim 5 wherein a hydraulic locking of said ring is achieved by means of small pistons whose respective cylinders are hydraulically connected through means which pass through the center of the distributor operatively connected with stop valves which rotate with the shaft and are supplied through said rotating hydraulic coupling.

* * * * *